United States Patent [19]

Logsdon

[11] Patent Number: 5,072,911

[45] Date of Patent: Dec. 17, 1991

[54] BARRIER MOLD FOR FORMING OPENINGS IN CONCRETE STRUCTURES

[75] Inventor: Duane D. Logsdon, Fullerton, Calif.

[73] Assignee: The Logsdon Foundation, Stanton, Calif.

[21] Appl. No.: 547,873

[22] Filed: Jul. 3, 1990

[51] Int. Cl.[5] ..... E04G 15/00

[52] U.S. Cl. ..... 249/61; 52/220; 52/577; 220/3.4; 249/39; 249/178; 249/184

[58] Field of Search ..... 249/39, 61, 53 R, 83, 249/175, 177, 178, 184, 186; 52/576, 577, 220; 206/507, 511, 516, 519; 220/3.4

[56] References Cited

U.S. PATENT DOCUMENTS

| | | | |
|---|---|---|---|
| 3,294,358 | 12/1966 | Hagedorn | 249/175 |
| 3,346,230 | 10/1967 | Tolf, Jr. | 249/177 |
| 3,389,851 | 6/1968 | Clark | 206/519 |
| 3,447,715 | 6/1969 | Beney | 206/507 |
| 3,933,336 | 1/1976 | Tolf, Jr. | 249/177 |
| 4,706,927 | 11/1987 | Lawall | 249/39 |
| 4,742,585 | 5/1988 | Logsdon | 52/577 |

*Primary Examiner*—James C. Housel

*Attorney, Agent, or Firm*—Joseph C. Andras

[57] ABSTRACT

Concrete barrier structures for use in forming holes in concrete slabs or the like can be constructed so as to include a peripheral wall shaped as the frustum of a right circular cone having an upper end and a lower end. A closure is provided to close off the upper end of the peripheral wall. A series of equally spaced, identical upper supports are located on the exterior of this peripheral wall intermediate the ends of this wall. Grooves are provided on the interior of the peripheral wall for accommodating the upper supports on an adjacent, nested barrier structure. Depending upon the depth or thickness of a slab only one of such a barrier structure may be used with its lower end of a horizontal surface when the slab is cast in place or two or more of the barrier structures may be placed on one another with any two adjacent barrier structures located with the uppermost barrier structure either resting on the upper supports of the next lower barrier structure in an upper position or being located with such supports on the lowermost barrier structure fitting into the grooves on the uppermost barrier structure in a lower position.

6 Claims, 4 Drawing Sheets

BARRIER MOLD FOR FORMING OPENINGS IN CONCRETE STRUCTURES

BACKGROUND OF THE INVENTION

The invention set forth in this document pertains to new and improved concrete barriers which are intended to be primarily useful in forming vertically extending holes in concrete slabs or similar structures.

Virtually everyone knows that concrete slabs or related structures are usually formed by casting or spreading a "wet" concrete mixture usually containing a hydraulic cement, aggregate and water onto a horizontally extending surface upon which the slab of the concrete is to be located, "working" or "finishing" the wet mixture so as to remove pockets of entrained air and obtain a desired surface configuration and then allowing the wet mixture to harden or "set" so as to form the final slab or other sturcture. Complications have often been encountered whenever it has been necessary or desirable to locate holes extending through such slabs or other structures.

In the past, and even to some degree currently, such holes have been created by workers erecting barricades on a surface out of any conveniently available material at a job site prior to the casting or location of the "wet" concrete mixture on the surface so as to hold back the wet mixture from the locations where holes are desired. This type of procedure is considered disadvantageous for any one or more of a series of different reasons.

Frequently an undesired amount of time is required to locate the materials to construct such barricades and to erect them. On occasion the construction of such barricades has not been effective to adequately hold back "wet concrete" from an area where a hole is desired. Also, the holes created by this type of expedient do not normally have a desired "smooth" or "clean cut" surface configuration.

An understanding of the present invention does not require a more extensive consideration of all of the disadvantages of the this type of "traditional" approach to forming holes in concrete structures. A recognition of the limitations and disadvantages of the creation of holes in a concrete slab or the like by erecting barricades out of any conveniently available material at a job site has resulted in the development of a number of specialized structures for use in creating holes or cavities in concrete slabs or the like in specialized situations.

As an example of this, so called "tub boxes" have been used in forming cavities in solidified concrete in order to accommodate pipes as are used in connecting bathtubs into a complete plumbing system. At least some of such tub boxes have been constructed by molding a polymer which is inert with respect to concrete so as to form a container having areas which can be knocked out of the walls of such boxes so as to accommodate pipes and the like and then installing such boxes in areas where slabs are to be cast from "wet" concrete.

After the concrete has set portions of or covers for such boxes have been removed so as to expose internal cavities or holes of shapes corresponding to the interiors of such boxes. Such cavities or holes may contain small quantities of concrete where the "wet" concrete has flowed around a pipe extending through a hole in such a box but in general have substantially "clean" interiors. Of course, the configuration of concrete shapes or slabs created with other differently constructed barriers will differ dependent upon the nature of the barrier used.

From this latter sentence it will be apparent that a number of different concrete barriers have been developed and used in the past for various specific applications. In spite of this it is considered that there is still a need for new and improved concrete barriers which are relatively inexpensive and which can be easily and conveniently used to create vertically extending holes having desirable interior surfaces through concrete slabs or the like of various different thicknesses. As subsequently indicated this latter is considered important.

BRIEF SUMMARY OF THE INVENTION

A broad object of the invention is to fulfill the need indicated in the preceding paragraph by providing new and improved concrete barriers. From this it will be apparent that the invention is intended to provide concrete barriers which can be easily and conveniently constructed at a comparatively nominal cost and which are of such a character that they can be easily and conveniently used to create holes in solid concrete slabs having an intended "smooth" interior configuration.

The invention is also intended to provide concrete barriers which are of such a character that only a series of identical barriers need be stocked by a supplier of such barriers or at a job site in spite of the fact that the barriers of the invention are only of a comparatively small height suitable for use in forming holes in concrete slabs which are of a common, comparably limited thickness and in spite of the fact that holes in slabs or the like of greater thicknesses are often required. As previously indicated this is considered important.

The concrete barriers of the invention can be used to form holes as required in slabs of commonly encountered thicknesses by virtue of the fact that two or more of such barriers can be used together in forming holes of greater length than can be formed using a single one of such barriers. As subsequently indicated this requires that the concrete barriers of the invention have to be specially shaped or constructed. This does not preclude the concrete barriers of the invention from being used alone.

In accordance with this invention these various objectives are achieved by providing a concrete barrier structure which is intended to be used in forming holes in concrete bodies such as slabs and which is constructed so as to include a vertically extending peripheral wall means having upper and lower ends, a closure means for closing off the upper end of the peripheral wall means, a series of upper support means located on the peripheral wall for use in holding the lower end of another identical barrier structure in an elevated or upper position, and a series of groove means located on the peripheral wall for use in accommodating the upper support means on such another structure so as to allow the other structure to be moved from the elevated or upper position to a lower position in which the other structure does not extend upwardly from the barrier structure as far as it extends when in the upper or extended position.

BRIEF DESCRIPTION OF THE DRAWING

Because of the nature of this invention it is best more fully explained with reference to the accompanying drawing in which.

Figure 1:
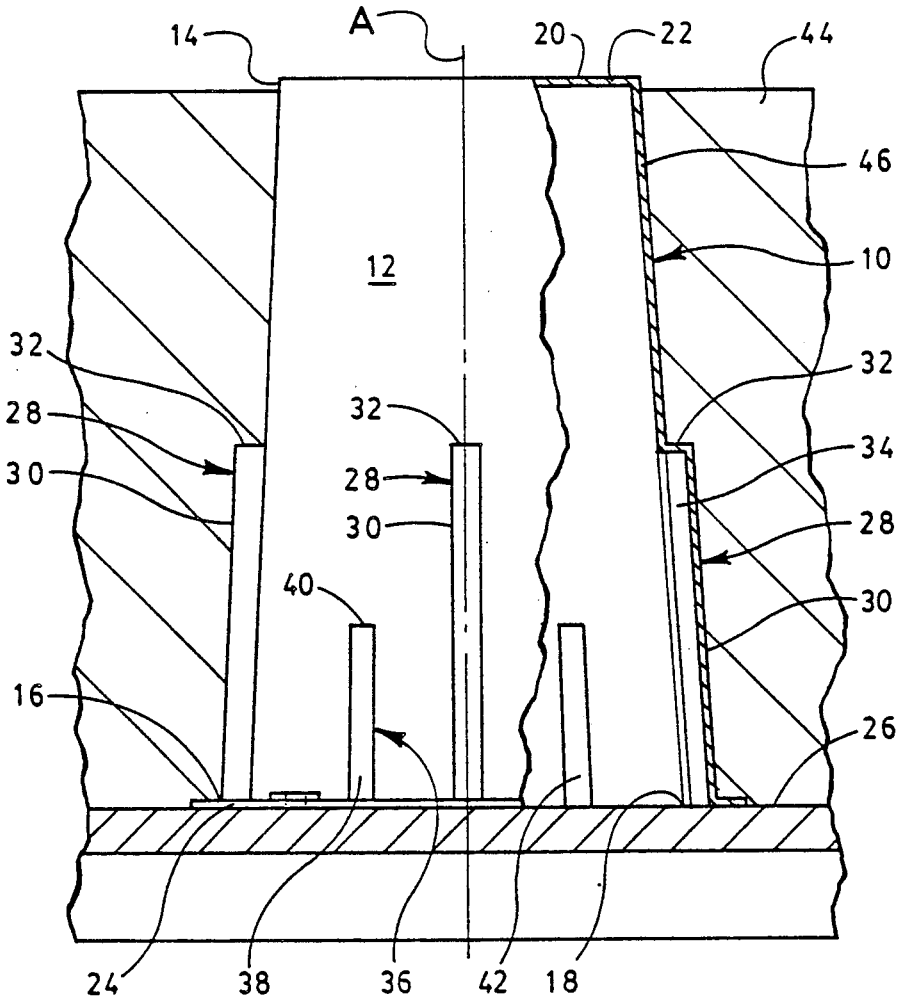
FIG. 1 is a side elevational view of a presently preferred embodiment or form of a concrete barrier structure in accordance with this invention as it is used in creating a hole in a concrete slab on a horizontal support such as a deck, the slab and the deck being broken away and the barrier structure being partially broken away so as to facilitate the subsequent explanation of the invention.
Figure 2:
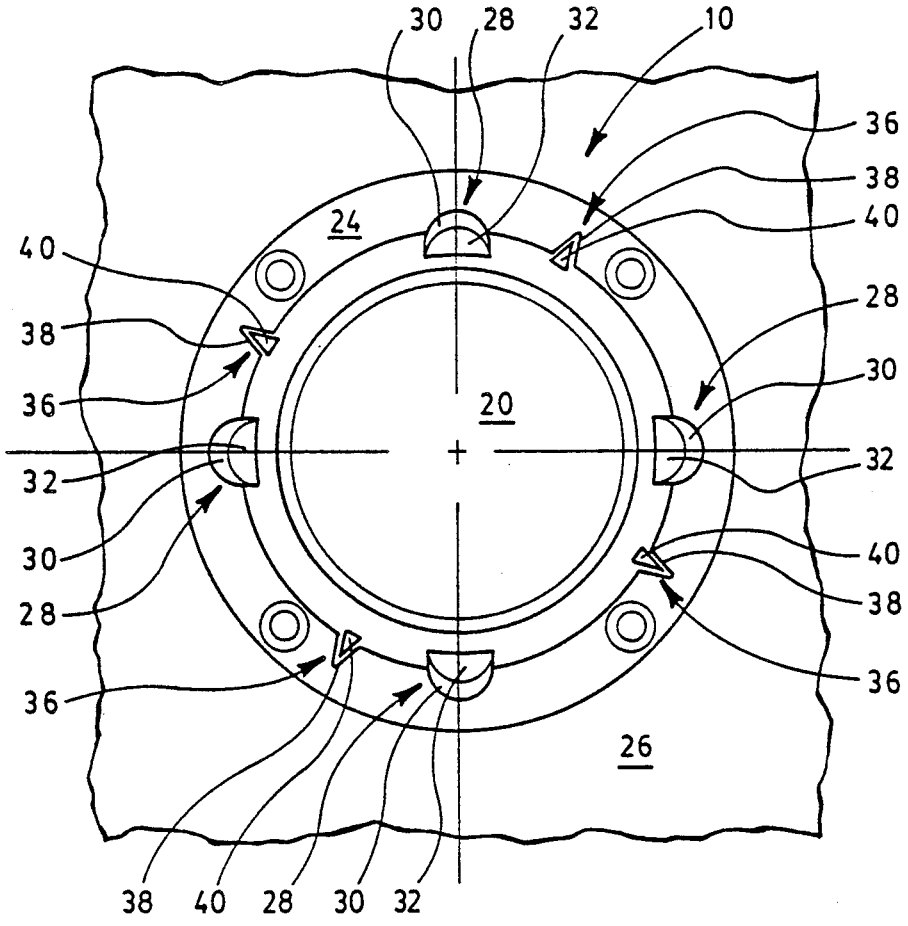
FIG. 2 is a top plan view of the barrier structure shown in the preceding figure in a location where a hole is desired on the horizontal support shown in FIG. 1.

Those familiar with the art of field of plastic concrete barriers will realize that the present invention utilizes the essentially intangible concepts or principles set forth in the dependent claims forming a part of this document and that the drawing is not intended to be a product drawing showing structures of the invention drawn to any precise scale. They will also realize that these concepts or principles can be embodied within various somewhat differently constructed or appearing barrier structures through the use or exercise of routine skill or ability in the art or field indicated. For this reason the invention is not to be considered to be limited to structures which are shaped in precisely the manner in which the illustrated barrier structures are shaped.

DETAILED DESCRIPTION OF THE PREFERRED EMBODIMENT

A series of concrete barrier structures 10 in accordance with the invention are illustrated in the various different figures of the drawing. These structures 10 are identical. All of the structures 10 are preferably formed as an integral or one-piece structure by common injection molding techniques out of a self supporting polymer which (1) is inert or substantially inert with respect to a "wet" concrete mixture or to the solid concrete formed by the setting of such a mixture, and (2) is sufficient resilient or flexible to be capable of withstanding the physical abuse normally encountered in the construction field.

Although a number of common polymer compositions possess these physical characteristics, it is considered that it is probably best to form the structures 10 out of a polyolefin such as a polyethylene since the cement in concrete will not normally bond to it or degrade it in any manner. In some cases this may be desirable in facilitating the removal of concrete which for one reason or another may have gotten in an undesired location or, if it should be desirable, in facilitating the removal of a barrier structure from a hole created using such a structure.

Figure 4:
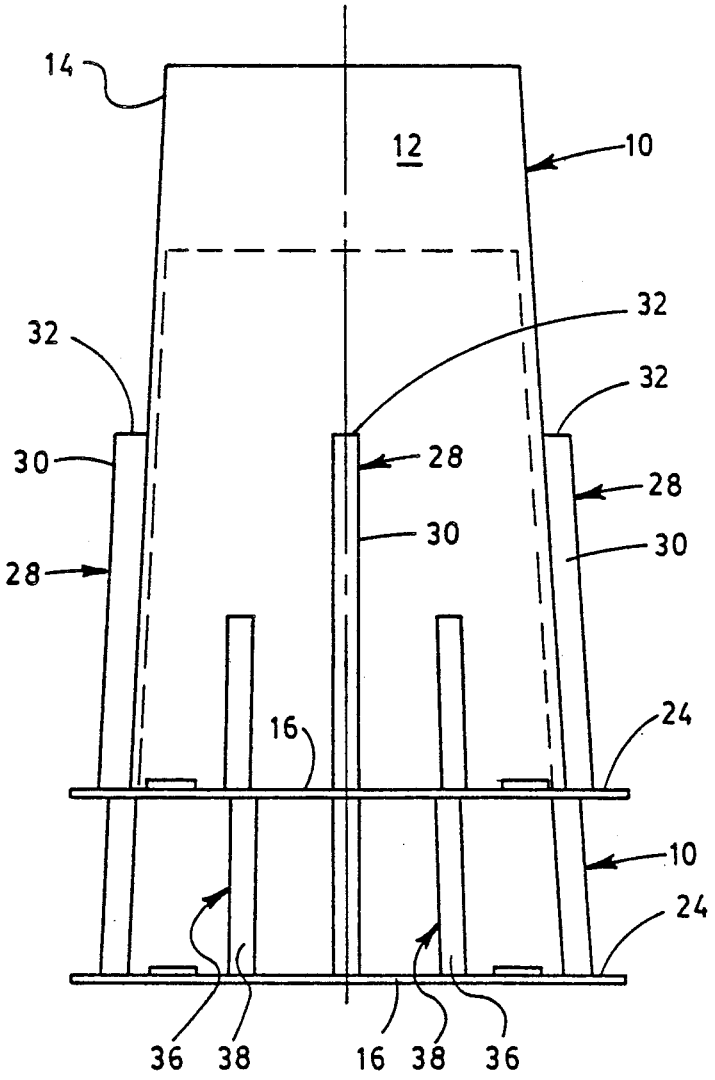
FIG. 4 is a view corresponding to FIG. 3 showing the manner in which the two structures can be assembled so as to be capable of being used to create a different hole which is of a length which is intermediate to the lengths of such holes, this view being partially broken away so as to show how parts fit when two structures are assembled as indicated in this figure.

A presently preferred barrier structure 10 of the invention includes a vertically extending peripheral wall 12 having the shape of a frustum of a right circular cone so as to be concentrically located about a central axis A as indicated in FIG. 1. This wall has an upper end 14 and a lower end 16. These ends 14 and 16 are located so as to extend perpendicularly to the axis A. The taper of the wall 12 is such as to permit barrier structures 10 to be "nested" or fitted together as indicated in FIG. 4 of the drawing.

When two barrier structures 10 are fitted together in this manner the interior edge 18 of the lower end 16 preferably rests lightly against the wall 12 so as to normally block the movement of "wet" concrete between the edge 18 and the wall 12. The taper of the wall 12 is also such that when two of the barrier structures 10 are in the position shown in FIG. 3 the spacing between the edge 18 and the wall 12 is sufficiently small so that comparatively little "wet" concrete will normally move between the edge 18 and the wall 12.

The upper end 14 of the peripheral wall 12 is closed off by a closure 20. Although in theory this closure 20 can be a separate member mounted on the wall 12 in any convenient manner, in practice it is most desirable and economic to form the closure 20 as shown so that it is integral with the peripheral wall 12. In order to facilitate the removal of the closure 20 it is possible to form an annular groove 22 of lesser thickness than the adjacent portions (not separately numbered) of the closure 20 and the peripheral wall 12.

This groove 22 may be referred to as a "knock out" groove 22 since it is intended to make it possible to separate the closure 20 from the end 14 of the wall 12 through the use of a hammer or the like. The use of this groove 22 is considered optional since it is normally possible to remove the closure 20 by the use of a sharp cutting tool. Frequently this closure 20 will be removed along with a portion of the peripheral wall 12 after a structure 10 has been used.

A comparatively small flange 24 for use in supporting a barrier structure 10 upon a horizontal surface 26 may be located on the lower end 16 of the peripheral wall 12 so as to extend outwardly from the end 16 perpendicularly to the axis A. The use of this flange 24 is considered preferable over setting the lower end 16 directly upon such a surface 26 because it is more difficult for "wet" concrete to flow between such a flange 24 and such a surface 26 as the barrier structure 10 is used than it would be for such concrete to flow under the lower end 16 if the lower end 16 was not attached to the flange 24 or something else serving its function.

It is considered that the weight of "wet" concrete applied to the flange 24 as a structure 10 is used will tend to a degree to hold the structure 10 in place. This is desirable in preventing the location of the structure 10 from shifting as concrete is poured. It is also considered that the weight of such concrete will tend to hold the flange 24 against the surface 26 so as to tend to form what may be regarded as a partial seal against "wet" concrete leaking between the flange 24 and the surface 26.

A structure 10 also includes a series of equally spaced, identical, parallel, vertically extending hollow ribs 28 which are located in the peripheral wall 12 so as to extend upwardly from the lower end 16. It will be noted that these ribs 28 extend outwardly from the peripheral wall 12 so as to have exteriors 30 terminating in upper extremities 32 and in the flange 24. These upper extremities 32 are preferably of a flat configuration and extend perpendicular to the axis A.

Figure 3:
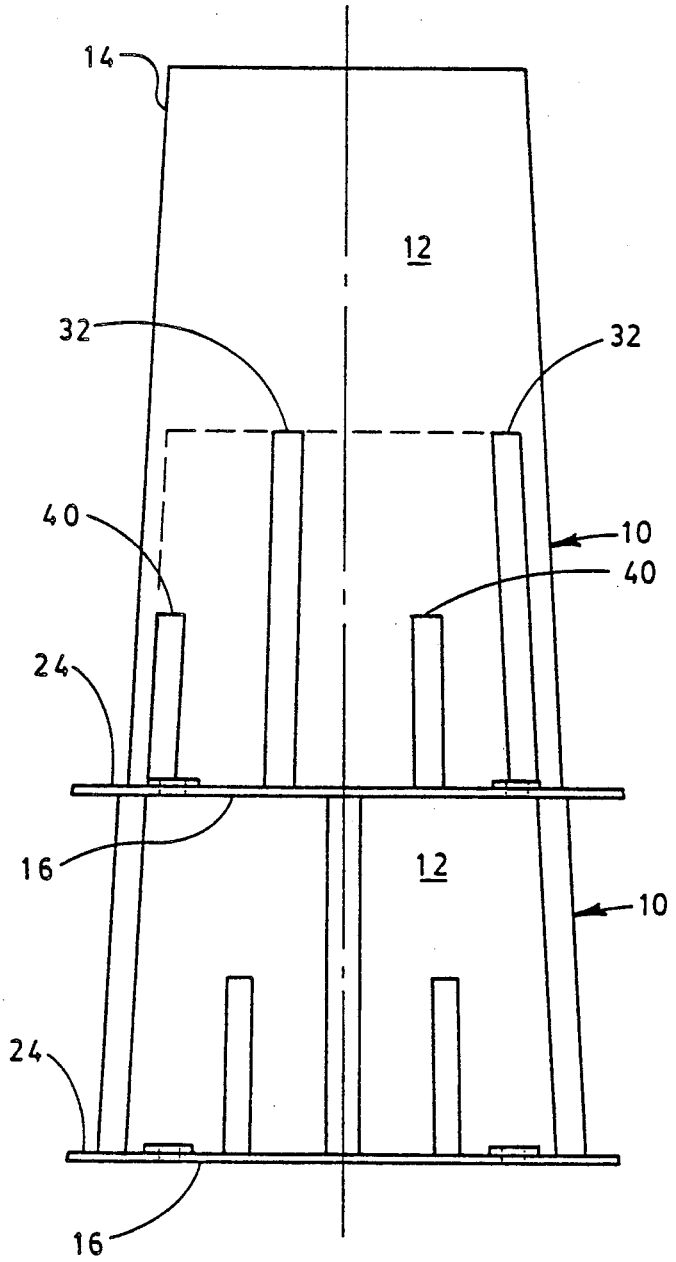
FIG. 3 is a side elevational view corresponding to FIG. 1 showing two identical barrier structures corresponding to the single structure shown in FIG. 1 stacked together on a horizontal support as shown in FIG. 1 so as to be capable of being used to create a longer or taller hole than possible to create with a single such structure.

When they are so formed the exteriors 30 of the ribs 28 serve as "upper support means" which are capable of supporting a flange on an adjacent barrier structure 10 when such an adjacent structure 10 is located in what may be referred to as an "upper position" as indicated in FIG. 3. In such an upper position the flange 24 in the uppermost barrier structure 10 rests against the extremities 32. Because of the dimensions of the two barrier structures 10 any misalignment of them will normally be immaterial as one structure 10 is held upon the other structure 10 as shown in this FIG. 3.

The ribs 28 also have hollow, vertically extending, groove shaped interiors 34 which extend through the flanges 24 generally along the lower edge 16. These interiors 34 are dimensioned so as to be capable of "accommodating" the ribs 28 on an adjacent barrier structure 10 when two such structures are located so as to be "nested" as shown in FIG. 4 of the drawing. With the structures 10 the uppermost of such barrier structures 10 can be freely moved downwardly on the lowermost of such barrier structures 10 to what may be referred to as a "lower position" as illustrated in FIG. 4.

Because of the manner in which they appear and their function the interiors 34 of the ribs 28 can be referred to as vertically extending "groove means" (no separate number) for allowing movement between two barrier structures into and out of nested positions as illustrated in FIG. 4. In order to achieve volumetric efficiency the barrier structures 10 will normally be shipped nested together in what may be regarded as "lower positions" as shown in FIG. 4.

The barrier structures 10 of this invention also preferably include other ribs 36 which are similar to the previously described ribs 28 but which differ from the ribs 28 in that they are shorter than the ribs 28. Thus, the ribs 36 also include vertically extending exteriors 38 terminating in upper extremities 40 and have groove-shaped interiors 42 which extend through the flange 24. These ribs 36 may be referred to as "lower support means" (not separately numbered) because their function is to support the flange 24 on an adjacent uppermost barrier structure 10 when two such barrier structures are in a lowermost position as shown in FIG. 4.

The use of the ribs 36 for this purpose is beneficial in preventing any chance of the uppermost of such barrier structures 10 from "jamming" down on the lowermost structure 10 in such a manner that it might be difficult to separate such structures 10. If the possibility of such structures 10 becoming "wedged" together when they are shipped or used is of no concern these ribs 36 can be omitted. It is also considered preferable to use both these ribs 36 and the ribs 28 since to a degree they stiffen the peripheral wall 12, making it possible to make this peripheral wall 12 as thin as possible so as to save on polymer material.

It is believed that the manner in which a barrier structure 10 or, in some circumstances, barrier structures 10 of the invention are used will be reasonably apparent from the preceding discussion. Normally when a comparatively thin, solid concrete slab such as a slab 44 illustrated in FIG. 1 is desired, a single barrier structure 10 will be located on a surface 26. This surface 26 can be of any type. Next a "wet" concrete mixture is cast around the structure 10 and on the surface 26 and "finished" in accordance with conventional practice. Then, after the concrete has set up, either the closure 20 can be hit by a hammer or similar instrument so as to be removed or any exposed part (not separately numbered) of the structure 10 can be removed by the use of a knife or the like. This will have the result of opening up a hole 46 formed by the setting of the concrete in the slab 44. At this point the hole 46 can normally be used in any intended manner such as, for example, in connection with the installation of a pipe or the like.

This hole 46 will have a smooth interior as a result of the fact that that portion of the structure 10 which is not removed will remain in the hole 46 so as to define its shape. This can be beneficial in preventing a worker's hands from being abraded by direct contact with concrete as the worker uses his or her hands in the hole 46. However, if desired that portion (not numbered) of the structure 10 which has not been previously removed can normally be easily removed from the hole 46 by reaching in the hole and cutting the remaining portion (not numbered) and then pulling it out of the hole.

Whenever holes are desired in slabs such as the slab 44 but which are thinner than the slab 44 various of the barrier structures 10 can be assembled on one another in the manners indicated in either FIGS. 3 or 4 until they project upwardly at least to the desired depth or thickness of the intended slab. At this point the steps indicated in the preceding can be repeated so as to form a hole 46 and the hole 46 can be exposed or opened by steps as have been described. The fact that any normally desired hole height can be achieved in this manner using identical barrier structures is beneficial in reducing inventory problems.

I claim:

1. A concrete barrier structure comprising: which is adapted to be selectively used either (1) upon a horizontal surface so as to form a vertically extending opening in a solid concrete body after "wet" concrete has been cast around the exterior of said barrier structure and allowed to set up so as to form said body or (2) to support another structure which is identical to said barrier structure when said barrier structure is located upon a horizontal surface so as to form a vertically extending opening which is longer than said first mentioned opening after "wet" concrete has been cast around the exterior of said barrier structure and said other structure and then allowed to set up so as to form said body, said barrier structure a vertically extending peripheral wall means for retaining "wet" concrete, said wall means having a lower end and an upper end, said wall means being of such thickness and being tapered so that the lower end of said other structure can be selectively located around said peripheral wall means of said barrier structure in either an upper position in which said lower end of said other structure is between said ends of said peripheral wall means of said barrier structure with the peripheral wall means of said other structure extending around a part of said peripheral wall means of said barrier structure and extending upwardly from said upper end of said barrier structure or a lower position in which the upper end of said other structure is closer to said upper end of said barrier structure than in said upper position and in which said lower end of said other structure is also between said ends of said peripheral wall means of said barrier structure with the peripheral wall means of said other structure extending around a part of said peripheral wall means of said barrier structure and extending upwardly from said upper end of said barrier structure;

closure means for preventing "wet" concrete from entering the interior of said peripheral wall means at said upper end of said peripheral wall means, said closure means covering said upper end of said peripheral wall means of said barrier structure;

a series of equally spaced, identical, upper support means for holding said other structure in said upper position, said upper support means having upper extremities and being located on said peripheal wall means of said barrier structure, said upper support means of said barrier structure extending outwardly from said peripheral wall means of said barrier structure so as to each terminate the same distance from said lower end of said peripheral wall means of said barrier structure, the lower end of said other structure being capable of resting upon said upper extremities of said support means of said barrier structure when said other structure is in said upper position;

a series of equally spaced, identical, elongated vertically extending groove means for allowing movement of said other structure relative to said barrier structure between said lower position and said upper position, said groove means being located in said peripheral wall means of said barrier structure, said groove means in said other structure being capable of fitting around said upper support means on said barrier structure so as to allow such movement; and a series of equally spaced, identical lower support means for holding said other structure in said lower position, said lower support means having upper extremities and being located on said peripheral wall means of said barrier structure, said lower support means of said barrier structure extending outwardly from said peripheral wall means of said barrier structure so as to each terminate the same distance from said lower end of said peripheral wall means of said barrier structure, the lower end of said other structure being capable of resting upon said lower extremities of said support means of said barrier structure when said other structure is in said lower position.

2. A barrier structure as claimed in claim 1 wherein:

said peripheral wall means includes a series of equally spaced, identical, parallel vertically extending hollow ribs leading upwardly from said lower end of said barrier structure, the tops of said hollow ribs serving as said upper extremities, the interiors of said ribs serving as said groove means.

3. A barrier structure as claimed in claim 1 wherein:

said peripheral wall means is shaped as the frustum of a right circular cone having an axis, and said closure means extending perpendicular to the axis of said frustum of a cone.

4. A barrier structure as claimed in claim 3 including:

a flat flange means attached to said lower end of said peripheral wall means of said barrier structure so as to extend outwardly therefrom perpendicular to the axis of said frustum of a cone, said flange means being sufficiently large so that during the use of said barrier structure the weight of "wet" concrete cast around the exterior of said barrier structure will tend to hold said barrier structure against movement as said "wet" concrete is worked.

5. A barrier structure as claimed in claim 1 wherein:

all parts of said barrier structure are integral with one another and are formed of a self supporting polymer material which is inert with respect to "wet" concrete, and said closure means is delineated from said upper end of said peripheral wall means of said barrier structure by a groove of lesser thickness than adjacent portions of said closure means and said peripheral wall means of said barrier structure so as to facilitate removal of said closure means from the remainder of said barrier structure.

6. A barrier structure as claimed in claim 1 wherein:

said peripheral wall means includes a series of equally spaced, identical, parallel vertically extending hollow ribs leading upwardly from said lower end of said barrier structure, the tops of said hollow ribs serving as said upper extremities, the interiors of said ribs serving as said groove means;

said peripheral wall means is shaped as the frustum of a right circular cone having an axis;

said closure means extending perpendicular to the axis of said frustum of a cone;

all parts of said barrier structure are integral with one another and are formed of a self supporting polymer material which is inert with respect to "wet" concrete; and said closure means is delineated from said upper end of said peripheral wall means of said barrier structure by a groove of lesser thickness than adjacent portions of said closure means and said peripheral wall means of said barrier structure so as to facilitate removal of said closure means from the remainder of said barrier structure, and further comprising:

a flat flange means attached to said lower end of said peripheral wall means of said barrier structure so as to extend outwardly therefrom perpendicular to the axis of said frustum of a cone, said flange means being sufficiently large so that during the use of said barrier structure the weight of "wet" concrete cast around the exterior of said barrier structure will tend to hold said barrier structure against movement as said "wet" concrete is worked.

* * * * *